US007967517B2

(12) United States Patent
Wada

(10) Patent No.: US 7,967,517 B2
(45) Date of Patent: Jun. 28, 2011

(54) PRINTING SYSTEM AND CUTTING METHOD WHERE WHEN CUTTING INFORMATION IS NOT DETECTED, CUTTING OCCURS AT A SET LENGTH SET IN ADVANCE

(75) Inventor: Yoshinori Wada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 930 days.

(21) Appl. No.: 11/878,727

(22) Filed: Jul. 26, 2007

(65) Prior Publication Data

US 2008/0159800 A1 Jul. 3, 2008

(30) Foreign Application Priority Data

Dec. 28, 2006 (JP) ..... 2006-355539

(51) Int. Cl.
*B41J 11/00* (2006.01)

(52) U.S. Cl. ..... 400/621; 400/611; 399/384; 399/385; 399/387

(58) Field of Classification Search ..... 400/621, 400/611; 399/384, 385, 387
See application file for complete search history.

(56) References Cited

U.S. PATENT DOCUMENTS 4,147,080 A * 4/1979 Diesch et al. ..... 83/371
4,161,899 A * 7/1979 Strunc ..... 83/371
6,575,549 B1 * 6/2003 Silverbrook ..... 347/19
6,676,314 B2 * 1/2004 Tanaka et al. ..... 400/615.2

FOREIGN PATENT DOCUMENTS

| | | |
|---|---|---|
| EP | 1 602 501 A2 | 12/2005 |
| JP | 9-156174 | 6/1997 |
| JP | A-11-020278 | 1/1999 |
| JP | A 2007-128309 | 5/2007 |

OTHER PUBLICATIONS

STIC search Apr. 22, 2010.*

* cited by examiner

*Primary Examiner* — Matthew G Marini
(74) *Attorney, Agent, or Firm* — Oliff & Berridge, PLC

(57) ABSTRACT

A printing system comprising: a printing device having a printing portion and a printing control portion; and a cutting device having a cutting portion which cuts a continuous sheet, a conveying portion conveying the continuous sheet, a detecting portion detecting cutting information, and a cutting control portion which controls the cutting portion such that the continuous sheet is cut at a cutting position indicated by the cutting information, when the cutting information is detected at the continuous sheet within a predetermined range from a cutting position at an upstream side in a conveying direction of the conveying portion, and controls the cutting portion such that the continuous sheet is cut at a set length which is set in advance, when the cutting information is not detected at the continuous sheet within the predetermined range from the cutting position at the upstream side in the conveying direction, is provided.

17 Claims, 10 Drawing Sheets

PRINTING SYSTEM AND CUTTING METHOD WHERE WHEN CUTTING INFORMATION IS NOT DETECTED, CUTTING OCCURS AT A SET LENGTH SET IN ADVANCE

CROSS-REFERENCE TO RELATED APPLICATION

This application is based on and claims priority under 35 USC 119 from Japanese Patent Application No. 2006-355539 filed on Dec. 28, 2006.

BACKGROUND

1. Technical Field

The present invention relates to a printing system which prints on and cuts a continuous sheet, and to a cutting device and cutting method which cut a printed continuous sheet.

2. Related Art

Printing devices which print on continuous sheets have conventionally been known. In a case in which a continuous sheet which does not have perforations or the like is printed on and is accommodated in a stocker or the like, the continuous sheet must be cut before being accommodated in the stocker. Accordingly, there has been proposed a printing system in which a cutting device which cuts the continuous sheet is provided at the stage following the printing device, and the continuous sheet which has been printed on at the printing device is cut by this cutting device of the following stage.

Among such printing systems, there are those in which marks which indicate cutting positions are printed on the continuous sheet by the printing device of the preceding stage, and the marks are detected at the cutting device of the following stage, and the continuous sheet can be cut at the cutting positions indicated by the marks.

In a printing device which prints on a continuous sheet, because printing cannot be started right away from the leading end of the continuous sheet, a blank page at which no mark is printed is formed immediately after the start of printing. Further, a blank page is formed also after printing stops. In particular, in the case of a printing device in which plural printing stations are disposed in succession and which carries out multiple transfer, the blank pages are long. At the cutting device of the following stage, not only the portions which are actually printed, but also the blank pages are cut in units of the page length, in accordance with the size of the stocker or the like.

Note that, in conventional printing devices which use, as the continuous sheet, a sheet with holes in which holes for conveying are formed or the like and which convey the continuous sheet in units of pages, the continuous sheet is conveyed in units of pages from the start of the printing operation, and can similarly be conveyed in units of pages also when printing stops. Therefore, even if printing is restarted after the printing operation is stopped for a time, the blank pages until the printing on the continuous sheet is actually carried out are the page length unit, and cutting in units of the page length is always possible.

However, a printing device, which uses a sheet without holes as the continuous sheet and in which the conveyed amount is an inconstant length due to errors in the acceleration of the motors or the like, cannot carry out operation in units of a page length. Accordingly, the blank pages, which are formed in a state with no marks at the time of starting-up or at the time of stoppage, are not the page length unit.

SUMMARY

According to an aspect of the invention, there is provided: a printing system comprising: a printing device having a printing portion that prints print information onto a continuous sheet and prints cutting information indicating a cutting position for cutting the continuous sheet, and a printing control portion that controls printing of the printing portion; and a cutting device having a cutting portion that cuts the continuous sheet which has passed through the printing device, a conveying portion that conveys to the cutting portion the continuous sheet which has passed through the printing device, a detecting portion that detects the cutting information from the continuous sheet while the continuous sheet is conveyed by the conveying portion, and a cutting control portion which controls the cutting portion such that the continuous sheet is cut at the cutting position indicated by the cutting information, when the cutting information is detected at the continuous sheet within a predetermined range from a cutting position by the cutting portion at an upstream side in a conveying direction of the conveying portion, and controls the cutting portion such that the continuous sheet is cut at a set length which is set in advance, when the cutting information is not detected at the continuous sheet within the predetermined range from the cutting position by the cutting portion at the upstream side in the conveying direction of the conveying portion.

BRIEF DESCRIPTION OF THE DRAWINGS

Exemplary embodiments of the present invention will be described in detail based on the following figures wherein.

DETAILED DESCRIPTION

Exemplary embodiments of the present invention will be described in detail hereinafter with reference to the drawings.

First Exemplary Embodiment

Figure 1:
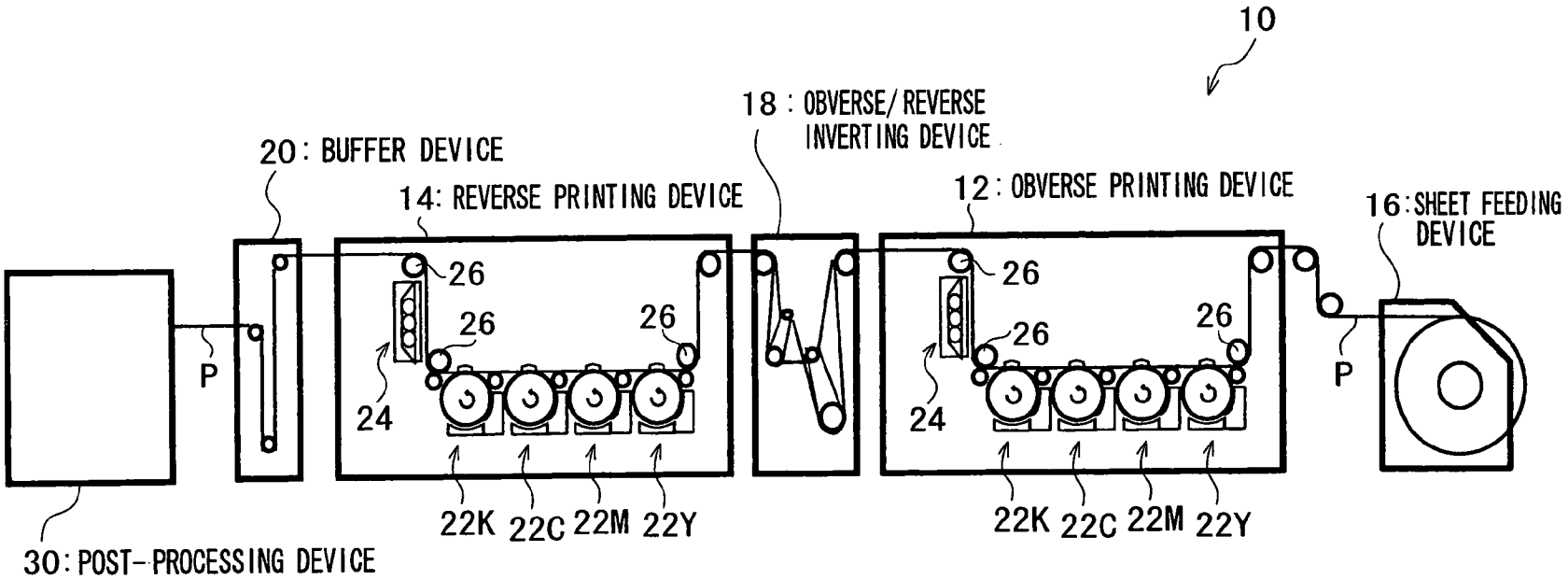
FIG. 1 is a drawing showing the structure of a printing system relating to first through third exemplary embodiments.

FIG. 1 is a drawing showing the structure of a printing system 10 relating to the present exemplary embodiment.

This printing system 10 is the printing system 10 which can print on a continuous sheet P which is a continuous sheet in which no holes for conveying are formed and at which fold lines and perforations are not formed. The printing system 10 is structured to include an obverse printing device 12 which prints on the obverse of the continuous sheet P, and a reverse printing device 14 which prints on the reverse of the continuous sheet P.

An obverse/reverse inverting device 18, which inverts the obverse and the reverse of the continuous sheet P, is disposed between the obverse printing device 12 and the reverse printing device 14. The obverse/reverse inverting device 18 inverts the obverse and the reverse of the continuous sheet P which has been printed on at the obverse printing device 12, and conveys the inverted continuous sheet P to the reverse printing device 14. The reverse printing device 14 prints on the reverse of the continuous sheet P which is conveyed from the obverse/reverse inverting device 18.

A sheet feeding device 16 is disposed at the stage preceding the obverse printing device 12. The sheet feeding device 16 feeds the continuous sheet P to the obverse printing device 12.

A post-processing device 30 is disposed, via a buffer device 20, at the stage following the reverse printing device 14. The post-processing device 30 corresponds to the cutting device of the present invention, and cuts the continuous sheet P which is conveyed from the reverse printing device 14.

The internal structures of the obverse printing device 12 and the reverse printing device 14 are the same. As shown in FIG. 1, the obverse printing device 12 and the reverse printing device 14 are respectively tandem-type printing devices at which image forming units 22Y, 22M, 22C, 22K of the four colors of Y (yellow), M (magenta), C (cyan), and K (black) are provided.

The obverse printing device 12 and the reverse printing device 14 have the same structure. In addition to the image forming units 22Y, 22M, 22C, 22K, plural conveying rollers 26 are provided at the obverse printing device 12 and the reverse printing device 14. The continuous sheet P is conveyed with respect to the image forming units 22Y, 22M, 22C, 22K by these plural conveying rollers 26.

The image forming units 22Y, 22M, 22C, 22K print information onto the continuous sheet P which is conveyed by the conveying rollers 26. Further, in vicinities of the print information, the image forming units 22Y, 22M, 22C, 22K print cutting information (hereinafter called marks) which indicate cutting positions for cutting portions where the print information are printed. These marks are printed at intervals of the page length of the print information. The information regarding the page length is designated in the print job from a host device 54 which will be described late.

The image forming units 22Y, 22M, 22C, 22K of the respective colors each have a photosensitive body, and a charging device, an exposing device, a developing device, and a transfer device are disposed at the periphery of each photosensitive body. In accordance with this structure, printing onto the continuous sheet P can be carried out by the electrophotographic method.

Note that, although the image forming units 22Y, 22M, 22C, 22K are described here as units which print in accordance with the electrophotographic method, the printing method is not particularly limited, and the image forming units 22Y, 22M, 22C, 22K may be units which print in accordance with the inkjet method for example.

A fixing device 24 is disposed at the conveying direction downstream side of the image forming units 22Y, 22M, 22C, 22K. The fixing device 24 fixes the toner images of the respective colors of YMCK which have been transferred onto the continuous sheet P by the image forming units 22Y, 22M, 22C, 22K. After fixed at the fixing device 24, the continuous sheet P is conveyed to the device at the following stage.

Figure 2:
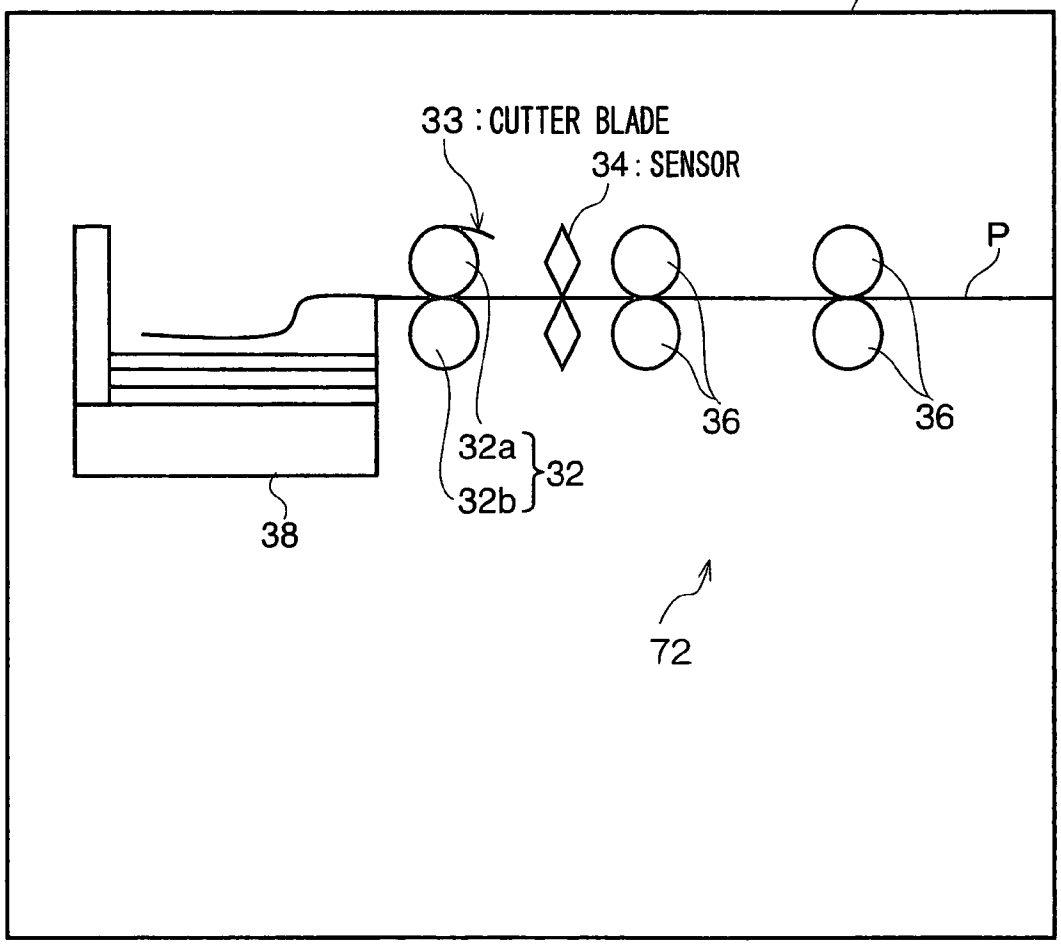
FIG. 2 is a structural drawing showing the structure of a post-processing mechanism portion provided at a post-processing device.

FIG. 2 is a structural drawing showing the structure of a post-processing mechanism portion 72 provided at the post-processing device 30.

A cutting roller pair 32 is provided at the post-processing mechanism portion 72 of the post-processing device 30. A cutting blade 33 is provided at an upper roller 32*a* of the cutting roller pair 32. The upper and lower rollers nip the continuous sheet P while rotating, and the continuous sheet P is cut by the cutting blade 33 of the upper roller 32*a*. In the present exemplary embodiment, because only one cutting blade 33 is provided at the cutting roller pair 32, the length of one rotation of the upper roller 32*a* is the minimum cutting interval.

The upper and lower rollers are structured so as to be movable in the vertical direction (the direction substantially orthogonal to the conveying direction of the continuous sheet P). Accordingly, when the cutting operation is not being carried out, the upper roller 32*a* is moved upward and a lower roller 32*b* is moved downward, and the upper and lower rollers 32*a*, 32*b* are thereby separated.

Further, plural conveying roller pairs 36 which convey the continuous sheet P to the cutting roller pair 32 are provided at the post-processing mechanism portion 72. A sensor 34, which is for detecting marks printed in the margin of the continuous sheet P, is disposed at the conveying direction upstream side of the cutting roller pair 32. Note that reading portions of the sensor 34 are disposed at both the upper side and the lower side of the conveying path so that not only marks which are printed on the obverse of the continuous sheet P which is conveyed on the conveying path, but also marks which are printed on the reverse can be detected.

A stocker 38 is provided at the conveying direction downstream side of the cutting roller pair 32. The continuous sheet P which is cut by the cutting roller pair 32 (hereinafter called cut objects) is accommodated in the stocker 38.

At the post-processing device 30, basically, at a portion where there is no mark, the continuous sheet P is cut in intervals of a page length (hereinafter called set length) which is set in advance at the post-processing device 30, and, at a portion where there is a mark, the continuous sheet P is cut at the cutting position indicated by the mark. However, at the border portion between a portion where there is no mark and a portion where there is a mark, the cutting position is adjusted by a cutting method which will be described later.

Figure 3:
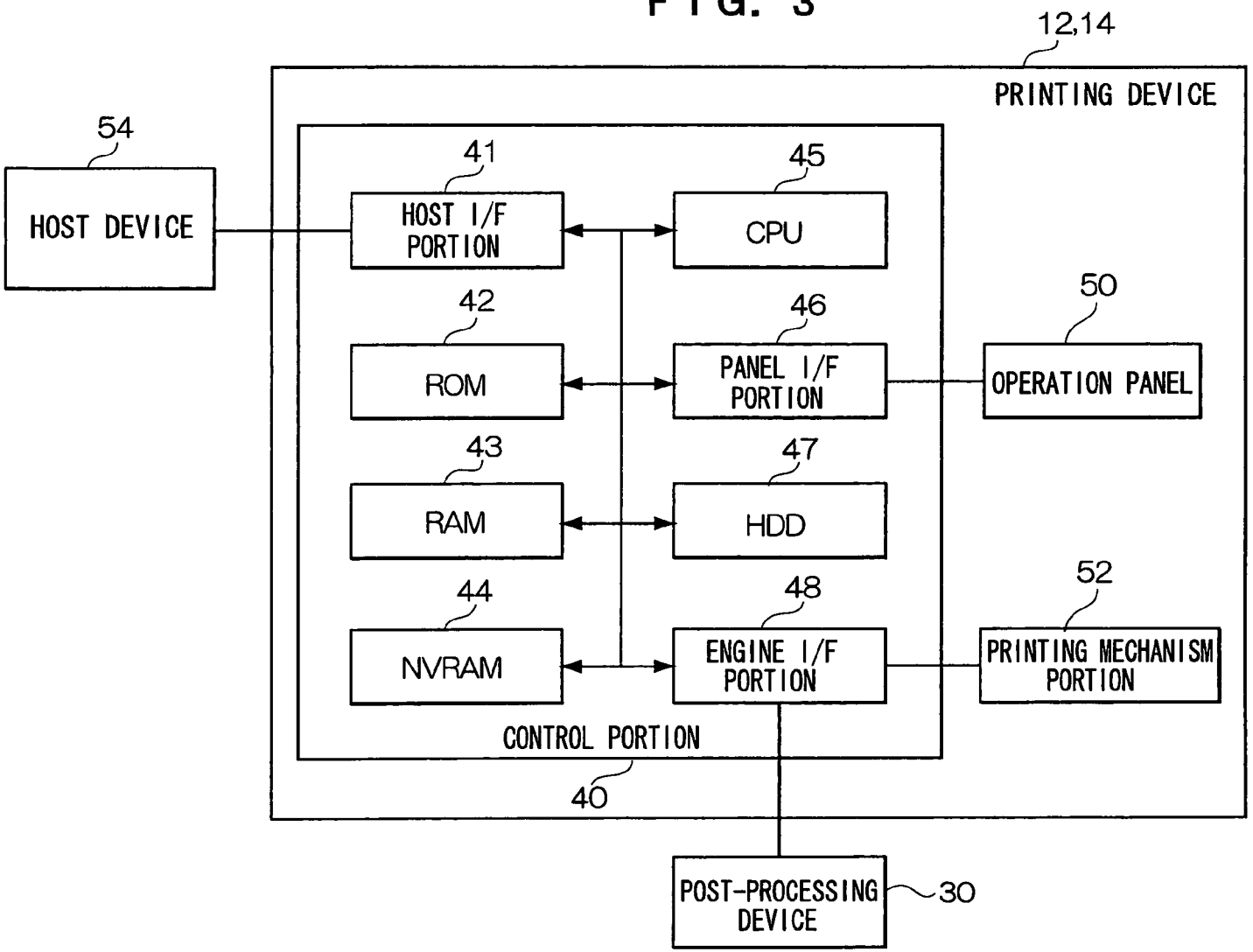
FIG. 3 is a block diagram showing the structure of a control system of an obverse printing device and a reverse printing device.

FIG. 3 is a block diagram showing the structure of the control system of the obverse printing device 12 and the reverse printing device 14. Note that the control systems of the obverse printing device 12 and the reverse printing device 14 also have the same structure.

The obverse printing device 12 and the reverse printing device 14 have a control portion 40, an operation panel 50, and a printing mechanism portion 52.

The printing mechanism portion 52 is structured so as to include the image forming units 22Y, 22M, 22C, 22K, the conveying rollers 26, and the fixing device 24 as described by using FIG. 1, and functions as the printing portion which actually prints on the continuous sheet P.

The control portion 40 includes a host interface (I/F) portion 41, a ROM 42, a RAM 43, an NVRAM 44, a CPU 45, a panel I/F portion 46, an HDD 47, and an engine I/F portion 48.

The host I/F portion 41 is connected to the host device 54. The obverse printing device 12 and the reverse printing device 14 acquire print jobs or control signals from the host device 54 via the host I/F portion 41, and transmit various types of messages such as notification of an error, notification that processing has been completed normally, and the like to the host device 54.

Note that the host device 54 is a device which generates and transmits print jobs or various types of control signals for the obverse printing device 12 and the reverse printing device 14. Print information to be printed onto the continuous sheet P, printing conditions at the time of printing the print information, and the like are included in the print jobs.

Programs executed by the CPU 45, data needed for processing at the CPU 45, and the like are stored in the ROM 42.

The RAM 43 is used as a work memory by the CPU 45.

The NVRAM 44 is a nonvolatile RAM, and network addresses, device IDs, and the like are stored therein.

The panel I/F portion 46 is connected to the operation panel 50. Via the panel I/F portion 46, the CPU 45 causes messages relating to printing to be displayed on the operation panel 50, and acquires various types of information inputted from the operation panel 50 and uses the acquired information to control the device.

Programs executed by the CPU 45, data needed for processing at the CPU 45, and the like are stored in advance in the HDD 47. Further, the print information and the like of the print jobs received from the host device 54 are temporarily stored in the HDD 47.

The engine I/F portion 48 is connected to the printing mechanism portion 52. The CPU 45 controls the printing of the printing mechanism portion 52 via the engine I/F portion 48. Further, the post-processing device 30 is connected to the engine I/F portion 48 of the reverse printing device 14. The CPU 45 of the reverse printing device 14 transmits notification of start of printing, notification of stoppage of printing, notification of errors, and the like to the post-processing device 30 via the engine I/F portion 48.

By executing the programs stored in the ROM 42 and the HDD 47, the CPU 45 effects control of the printing operation of the printing mechanism portion 52 in accordance with the print jobs or the control signals received from the host device 54, and carries out display of various types of messages, and carries out processings such as transmitting notification of completion of printing, notification of an error, or the like to the host device 54, and the like.

Figure 4:
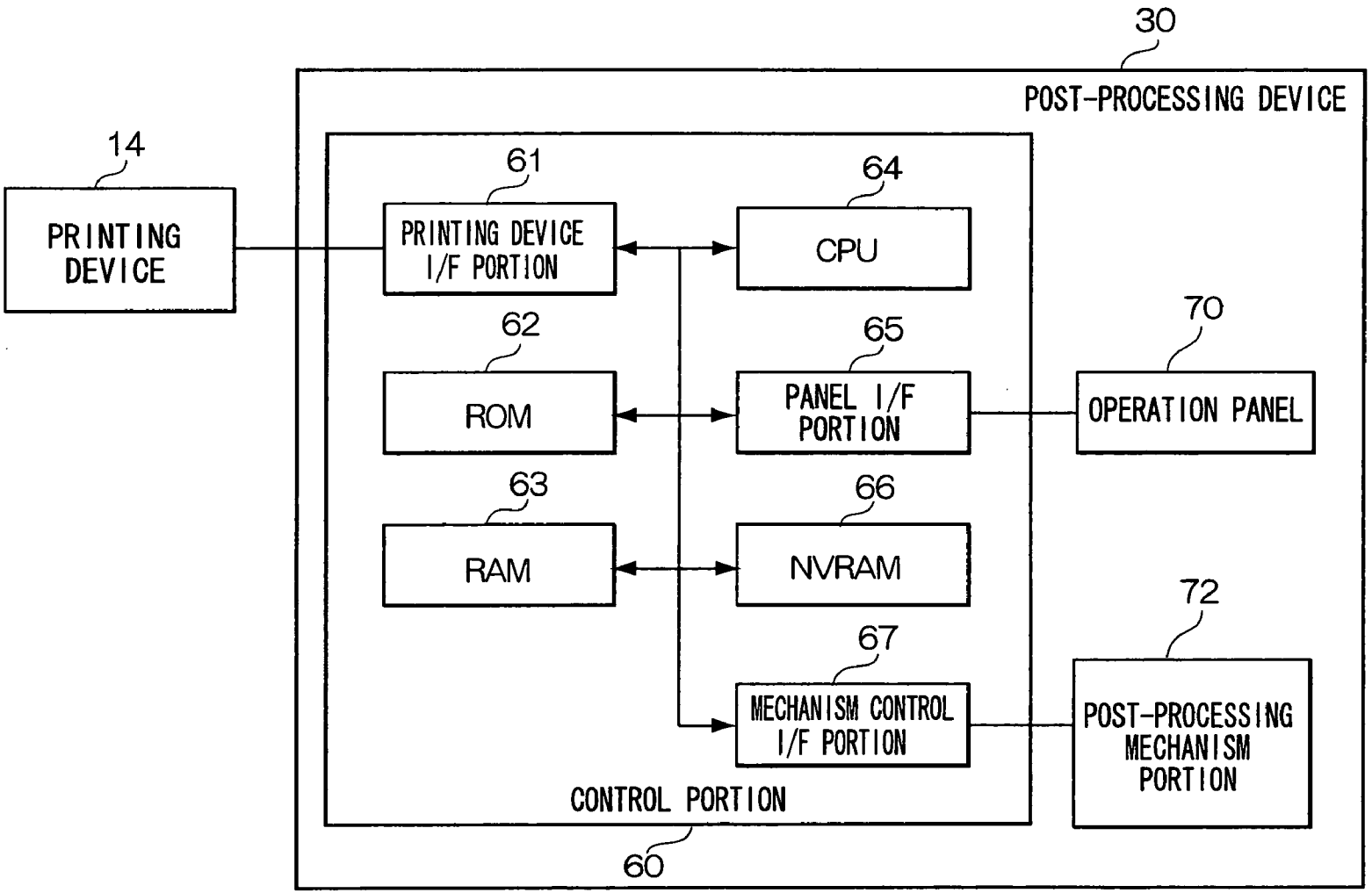
FIG. 4 is a block diagram showing the structure of a control system of the post-processing device.

FIG. 4 is a block diagram showing the structure of the control system of the post-processing device 30.

The post-processing device 30 has a control portion 60, an operation panel 70, and the post-processing mechanism portion 72.

The post-processing mechanism portion 72 is structured so as to include the cutting roller pair 32, the conveying roller pairs 36, the stocker 38, and the sensor 34 as described by using FIG. 2.

The control portion 60 includes a printing device I/F portion 61, a ROM 62, a RAM 63, a CPU 64, a panel I/F portion 65, an NVRAM 66, and a mechanism control I/F portion 67.

The printing device I/F portion 61 is connected to the reverse printing device 14. Via the printing device I/F portion 61, the post-processing device 30 can acquire notification of start of printing, notification of stoppage of printing, notification of an error, and the like from the reverse printing device 14, and can transmit various types of messages such as a notification of an error during the cutting operation, a notification that processing is completed normally, and the like to the reverse printing device 14.

Programs executed by the CPU 64, data needed for processing at the CPU 64, and the like are stored in the ROM 62.

The RAM 63 is used as a work memory by the CPU 64.

The NVRAM 66 is a nonvolatile RAM, and network addresses, device IDs, and the like are stored therein. The cutting interval (set length) at the time of cutting a portion at which no mark which indicates a cutting position of the continuous sheet P is printed, and the range of detection from a cutting position of the continuous sheet P at the time of judging the absence/presence of a mark, are also set in advance and stored in the NVRAM 66.

The panel I/F portion 65 is connected to the operation panel 70. Via the panel I/F portion 65, the CPU 64 causes messages relating to printing to be displayed on the operation panel 70, and acquires various types of information inputted from the operation panel 70 and uses the acquired information to control the device.

The mechanism control I/F portion 67 is connected to the post-processing mechanism portion 72. The CPU 64 controls the cutting operation of the post-processing mechanism portion 72 via the mechanism control I/F portion 67.

By executing the programs stored in the ROM 62, the CPU 64 acquires a notification of start of printing, notification of stoppage of printing, notification of an error, and the like which are received from the reverse printing device 14, and controls the cutting operation of the post-processing mechanism portion 72 in accordance with the acquired notification of start of printing or notification of stoppage of printing, and transmits various messages, such as notification of an error during the cutting operation or a notification that processing has been completed normally or the like, to the reverse printing device 14.

The printing processing of the obverse printing device 12 and the reverse printing device 14 of the printing system 10 of the present exemplary embodiment, and the cutting processing of the post-processing device 30, will be described next.

Figure 5:
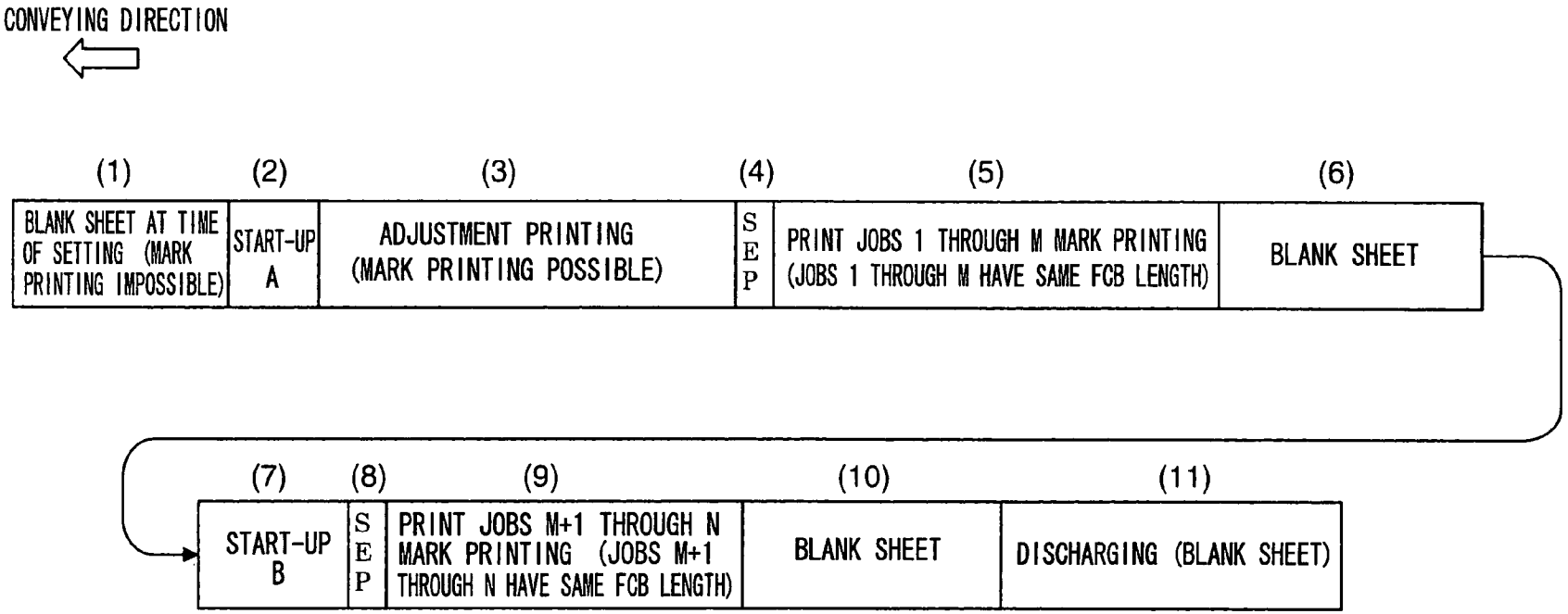
FIG. 5 is a drawing showing an example of a printed state of a continuous sheet P which is printed on in the printing system of the first exemplary embodiment.

FIG. 5 is a drawing showing an example of a printed state of the continuous sheet P which is printed at the printing system 10 of the present exemplary embodiment. Hereinafter, a summary of the printing processing of the present printing system 10 will be described by explaining the example shown in FIG. 5.

Figure 6:
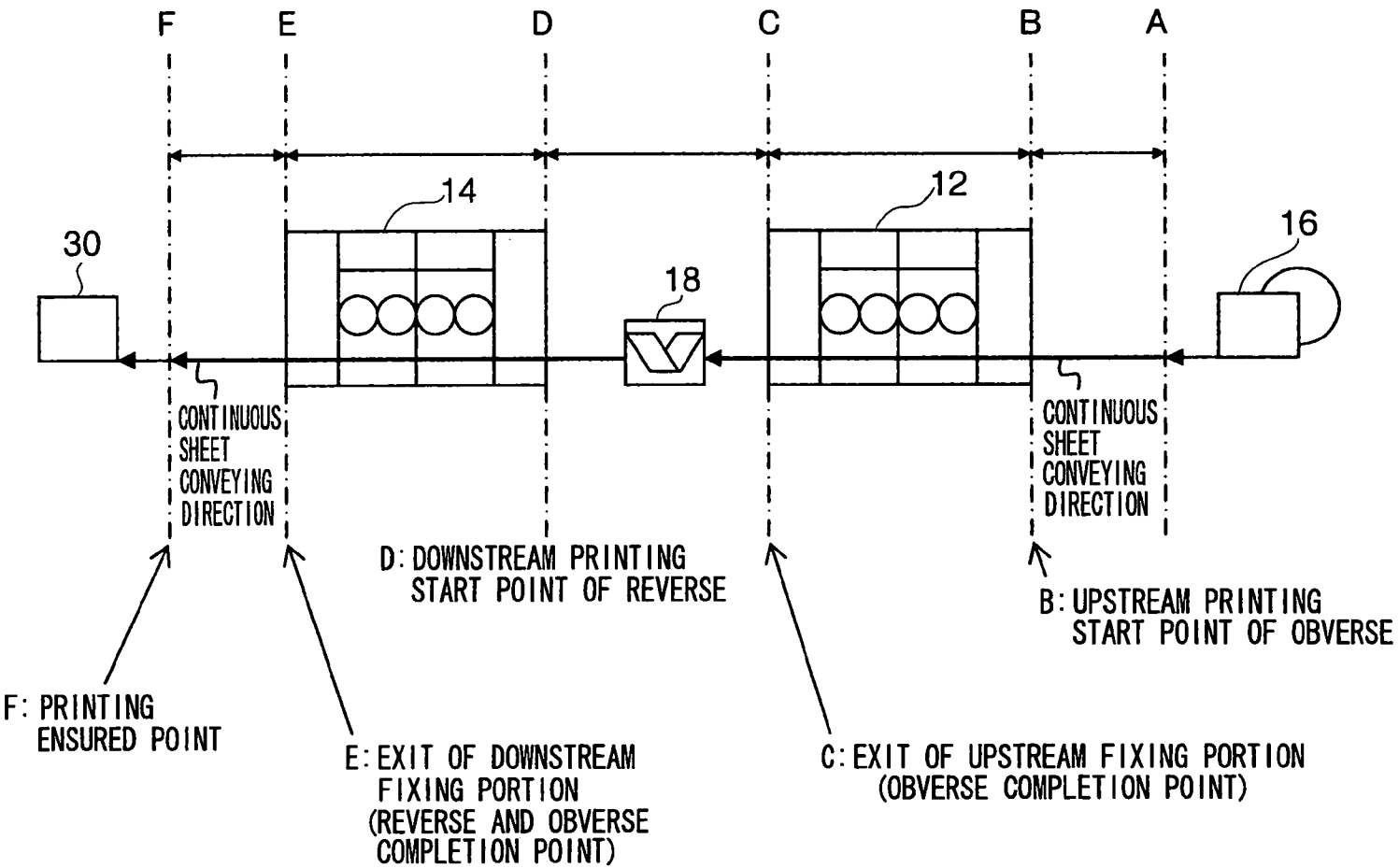
FIG. 6 is a drawing schematically showing the system structure of the printing system of the first through third exemplary embodiments.

Further, FIG. 6 is a drawing schematically showing the system structure of the printing system 10 of the present exemplary embodiment. Illustration of the buffer device 20 is omitted from FIG. 6.

Point A shown in FIG. 6 is the sheet feed starting point of the sheet feeding device 16. Point B is the printing starting point at the conveying direction upstream side of the continuous sheet P (the starting point of the obverse printing of the continuous sheet P). Point C is the exit of the fixing portion at the conveying direction upstream side of the continuous sheet P, and is the point at which the obverse printing is completed. Point D is the printing starting point at the conveying direction downstream side of the continuous sheet P (the starting point of the reverse printing of the continuous sheet P). Point E is the exit of the fixing portion at the conveying direction downstream side of the continuous sheet P, and is the point at which the reverse and the obverse printings are completed. Point F is a point at which printing of the continuous sheet P is ensured. Accordingly, even if a portion of the continuous sheet P which has been printed at the obverse printing device 12 or the reverse printing device 14 passes point C or point E, it is not considered that printing is completely finished if this portion has not passed point F.

First, in order to print on the continuous sheet P, the user takes-out and pulls-out the end portion of the continuous sheet P from the sheet feeding device 16, and sets the continuous sheet P so as to extend through the obverse printing device 12, the obverse/reverse inverting device 18, the reverse printing device 14, the buffer device 20, and the post-processing device 30. In the state in which the continuous sheet P is set in this way, because the portion of the continuous sheet P from B to F in FIG. 6 is a portion which cannot be printed on, this portion becomes a blank sheet as shown by (1) in FIG. 5. The length of this portion varies in accordance with the arrangement of the respective devices of the printing system 10.

Next, the user turns on the start switch (not shown) of the printing system 10, and starts the printing. In this way, warm-up operations are carried out at the respective devices of the printing system 10, and the continuous sheet P is conveyed in a state in which the both sides thereof are blank as shown in (2) of FIG. 5. At this time, because there are errors in the acceleration and the like of the motors, the amount of conveying is an inconstant length. Further, during this time period, a mark which indicates a cutting position cannot be printed. Note that, when the start switch is turned on, the program of the cutting processing, which cuts the continuous sheet P which has passed through the obverse printing device 12 and the reverse printing device 14, is started-up at the post-processing device 30, but this cutting processing will be described later.

When the warm-up operations of the printing system 10 have been completed, adjustment printing is carried out at the printing system 10 of the present exemplary embodiment. In this adjustment printing, an image (patch) for adjustment is printed onto the continuous sheet P as shown in (3) of FIG. 5 in order to adjust the image density, positional offset, and the like. At this time, during the first half of the printing, only the reverse is printed on, and thereafter, both the obverse and the reverse are printed on. The patch is printed asynchronously on the obverse and the reverse, and the densities and positions of the printed patches are read-in by unillustrated sensors, and density adjustment, position adjustment and the like are carried out.

Note that the mark which indicates the cutting position can be printed at the adjustment printing portion. However, because this portion is not a portion where print information of a print job is printed, this portion can be cut in any way at the post-processing device 30 provided that it is a size which can be accommodated in the stocker 38, and accordingly, it suffices to not print the mark. In the present exemplary embodiment, no mark is printed at the adjustment printing portion. Further, in the same way as (2) of FIG. 5, the amount of conveying of this portion as well is an inconstant length. Note that this adjustment printing itself is not a requisite operation, and does not always have to be executed at the time of start-up.

After the adjustment printing is completed, print information is printed in accordance with the print job from the host device 54. In the present exemplary embodiment, as shown in (4) of FIG. 5, before this print information is printed, a blank page (called a start separator hereinafter) is inserted and a mark for adjustment is printed on this start separator by the obverse printing device 12 and the reverse printing device 14. At the obverse printing device 12 and the reverse printing device 14 of the present exemplary embodiment, operation is carried out such that a start separator, which is of a length equal to the page length (print interval) of the print information which is printed immediately after the start separator, is inserted. Note that the mark for adjustment is printed in a margin of the continuous sheet P, that is, at the insertion start point of the start separator.

Next, as shown in (5) of FIG. 5, the obverse printing device 12 and the reverse printing device 14 print the print information of the print job onto the continuous sheet P. If there are plural print jobs, the print information of the plural print jobs are printed in succession. Further, the marks which indicate the cutting positions with respect to the printing information are also printed in the margin of the continuous sheet P, that is, at positions where the printed portions of the respective print information are to be cut. Also at the border position between the conveying direction upstream side end portion of the start separator and the print information of the print job, a mark for cutting this border position is printed.

Note that here, the page lengths (FCB lengths) of the respective print jobs which are printed in succession are the same length, and the printing mechanism portion 52 is controlled such that the respective marks are printed at intervals of the page length of the print information. Hereinafter, there are cases in which the marks for the print information are called cutting marks in order to distinguish them from the mark for adjustment.

When the printing of the first through the Mth print jobs which are designated from the host device 54 has been carried out at the obverse printing device 12 and the reverse printing device 14, the obverse printing device 12 and the reverse printing device 14 stop printing. Note that, when printing stops, the continuous sheet P is conveyed to point E which is the point of the exit of the downstream fixing portion. Therefore, as shown in (6) of FIG. 5, after the printing of the print jobs, a portion which is blank on both sides is generated. The length of the blank portion which is generated here is a length which is the sum of the errors and the length from E to F of FIG. 6.

After printing is stopped, when a print job is received from the host device 54 again, in the same way as in (2) of FIG. 5, warm-up operations are carried out, and a portion which is blank on both sides and is of an inconstant length is generated as shown in (7) of FIG. 5.

Then, the obverse printing device 12 and the reverse printing device 14 insert a start separator as shown in (8) of FIG. 5 (similar to (4) of FIG. 5), and carry out printing of print jobs as shown in (9) of FIG. 5 (similar to (5) of FIG. 5). After printing of the print jobs, printing is stopped, and, as shown in (10) of FIG. 5, the continuous sheet P is conveyed to point E which is the point of exit of the downstream fixing portion (similar to (6) of FIG. 5).

Here, when the start switch of the printing system 10 is turned off, the continuous sheet P is conveyed toward the conveying direction downstream side, and is discharged (see (11) of FIG. 5). The blank portion at the time of discharging is also a length which is the sum of the errors and the length from E to F in FIG. 6, and is an inconstant length.

In this way, portions at which no mark is printed and portions at which marks are printed are conveyed in succession to the post-processing device 30. As described above, because there are errors in the acceleration of the motors and the like, the amount of conveying is an inconstant length. Therefore, the portions at which no mark is printed are inconstant lengths. At portions where no mark is printed, the post-processing device 30 cuts the continuous sheet P at a set length which is set in advance. Further, at portions where marks are printed, the post-processing device 30 cuts the continuous sheet P in accordance with the marks.

Because cutting cannot be carried out at the minimum cutting interval of the cutting roller pair 32, in order to be able to cope with this minimum cutting interval, in the present exemplary embodiment, the start separator is inserted at the border between a portion where no mark is printed and a portion where a mark is printed, and control is effected such that the cutting interval of the border portion is greater than or equal to the minimum cutting interval of the cutting roller pair 32.

Figure 7:
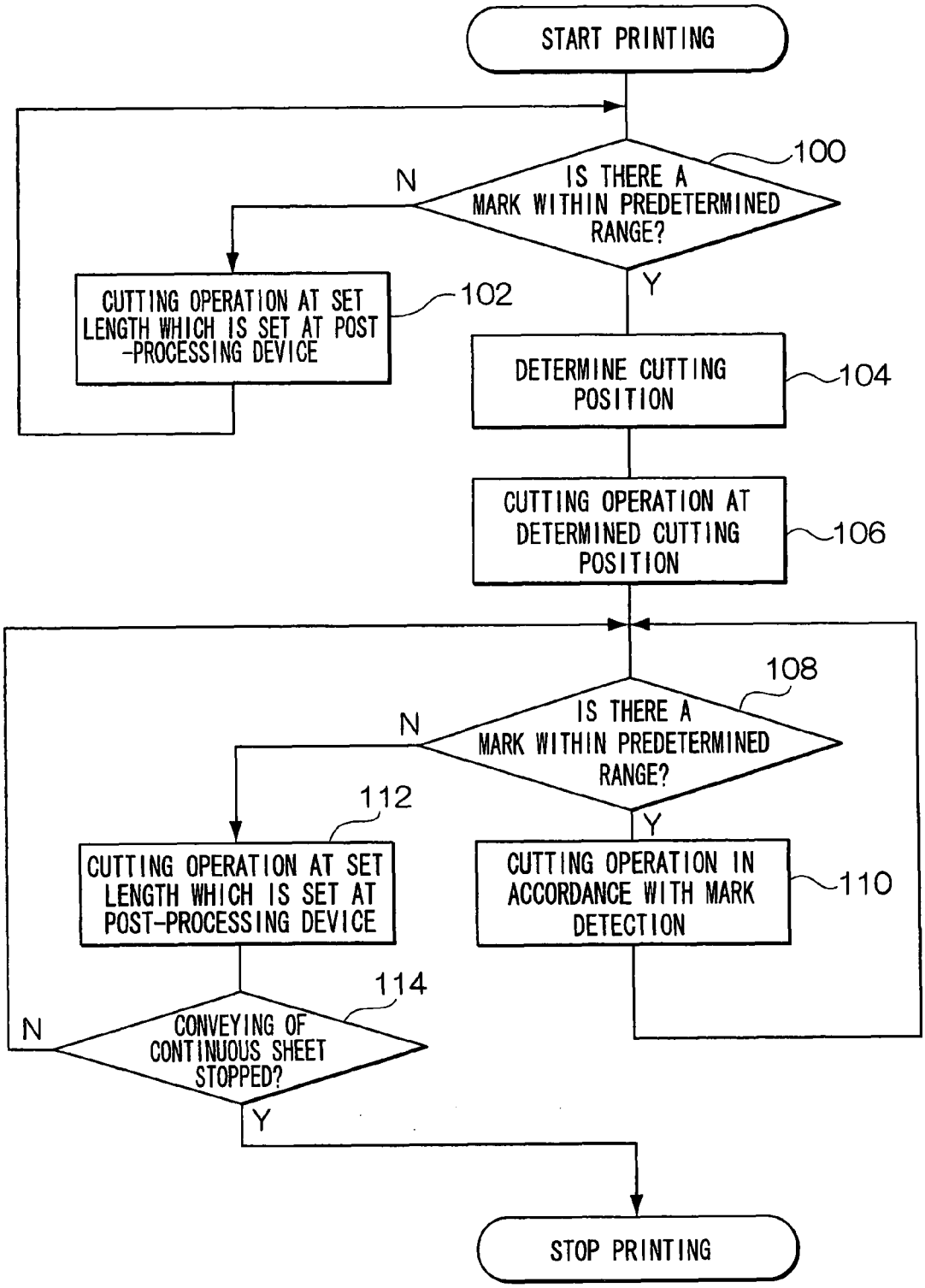
FIG. 7 is a flowchart showing the flow of a cutting processing program executed at the post-processing device in the first exemplary embodiment.

FIG. 7 is a flowchart showing the flow of a cutting processing program executed at the post-processing device 30.

This cutting processing is started-up at the time when the start switch of the printing system 10 is turned on as described above and printing starts. Note that, immediately after start-up, a blank sheet at which no mark is printed continues for a while. Therefore, during the period until a mark is detected, cutting is carried out at the page length which is set at the post-processing device 30.

In step 100, it is judged whether or not a mark is detected within a predetermined range from a cutting position which is cut at the page length set at the post-processing device 30. The value of the "predetermined range" for judging the absence/presence of a mark is set in advance at the post-processing device 30. For example, a value which is the same as the size of the stocker 38 or a value which is somewhat larger than the size of the stocker 38 may be set as the predetermined range. Further, a maximum value of the printing interval of the marks may be set in advance, and a value which is the same as this maximum value or a value larger than this maximum value may be set as the predetermined range. If the predetermined range is set to a value which is larger than the maximum value, errors in printing of the marks can be dealt with easily.

If the judgment in step 100 is negative, in step 102, cutting at the set length which is set in advance at the post-processing device 30 is carried out. After cutting, the routine returns to step 100. For example, in the example shown in above-described FIG. 5, because portions (1) through (3) are portions at which no mark is printed, the judgment in step 100 is negative, and cutting at intervals of the set length is carried out.

Note that this set length is stored in advance in the NVRAM 66. The value of the set length is not particularly limited, and may be a value which is the same as the "predetermined range" at the time of judging the absence/presence of a mark, or may be a value which is smaller than the predetermined range. Further, for the set length, the user may set an arbitrary value via the operation panel 70.

In a case in which the set length and the predetermined range are the same value, the sensor 34 and the cutting roller pair 32 can be disposed at substantially the same position, and therefore, the post-processing device 30 can be made compact.

If the user arbitrarily sets the set length, the user can use the blank cut objects for his/her own desired use.

On the other hand, if the judgment in step 100 is positive, there is a state in which the inserted position of the start separator of (4) or (8) of FIG. 5 reaches the reading position of the sensor 34 of the post-processing device 30, and the mark for adjustment which is printed with respect to the start separator has been detected. Therefore, in step 104, the cutting position of the continuous sheet P is determined such that the printed portion of the print job following the start separator is cut appropriately. In the present exemplary embodiment, from the start of the printed portion of the print job which follows the start separator, the continuous sheet P can be reliably cut at the positions indicated by the marks which are printed in order to cut the printed portion. Therefore, the cutting position is determined such that the cutting interval at the border portion between the portion where there is no mark and the portion where a mark exists (here, the portion from the final cutting position of the portion where there is no mark to the conveying direction upstream side end portion of the start separator) is not less than the minimum cutting interval of the cutting roller pair 32, and the cutting by the cutting roller pair 32 is controlled.

There are various methods for determining the cuffing position. Basically, after the cutting at the cutting roller pair 32, if the interval until the next cutting position is not made to be greater than or equal to the minimum cutting interval of the cutting roller pair 32, cutting at the next cutting position cannot be carried out. Accordingly, control is effected so that the continuous sheet P is not cut at a position which is less than the minimum cutting interval of the cutting roller pair 32 at the conveying direction upstream side from the cutting position shown by the lead mark of the printed portion of the print job, which mark is printed after the mark for adjustment.

Figures 8A, 8B, 8C:
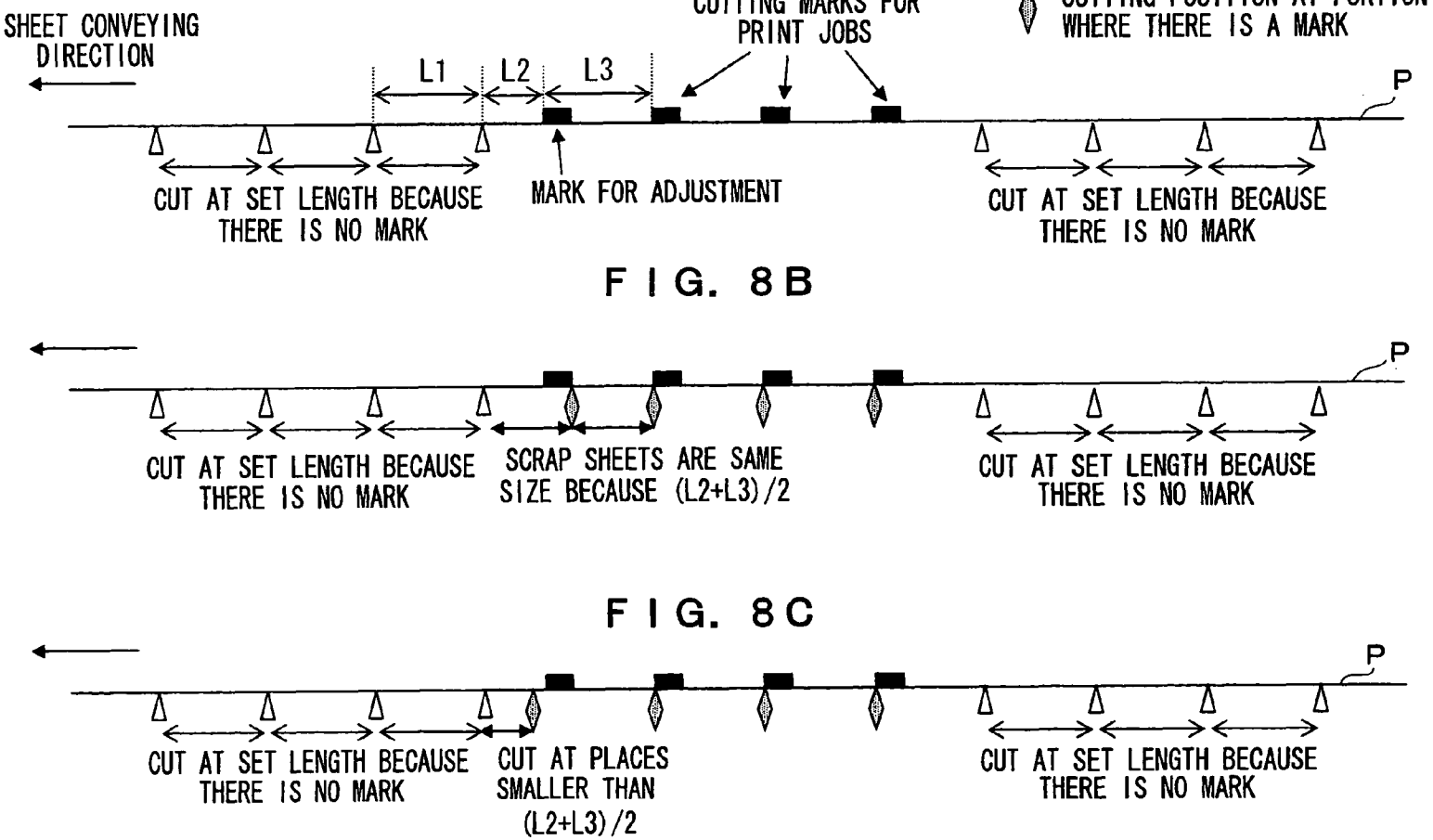
FIG. 8A is an explanatory drawing explaining a method of determining a cutting position.
FIG. 8B is an explanatory drawing explaining a method of determining a cutting position.
FIG. 8C is an explanatory drawing explaining a method of determining a cutting position.

FIGS. 8A through 8C are explanatory drawings for explaining methods of determining the cutting position. FIG. 8A is a drawing showing an example of a cutting image at the continuous sheet P, at which a mark for adjustment and cutting marks for the print job are printed, at a portion where these marks are not detected. As shown in FIG. 8A, at a portion where the marks are not detected, the continuous sheet P is cut at the set length (L1) which is set in advance at the post-processing device 30. The first mark in the conveying direction of the continuous sheet P is the mark for adjustment, and, next after this mark for adjustment, cutting marks for the print job are printed. The page lengths of the start separator and the print job are the same (L3) here. Further, the interval from the final cutting position of the portion with no mark to the cutting position indicated by the mark for adjustment is shown as L2.

As shown in FIG. 8B, a method of determining, as the cutting position, a position which is at the upstream side, by a length expressed by a value which is the quotient of the sum of L2 and L3 being divided by two, in the conveying direction of the continuous sheet P from the final cutting position of the portion where there is no mark, may be employed as the method of determining the cutting position. In this way, because the continuous sheet P is cut at the position where the border portion is divided exactly in half, the scrap sheets will be the same lengths. The page length of the print job is ensured to be a sufficient length, and at worst, about twice the minimum cutting interval of the cutting roller pair 32. Accordingly, even if the length of L2 is very small, the continuous sheet P can be cut at a position which is further toward a forward side by an amount which is greater than or equal to the minimum cutting interval of the cutting roller pair 32, from the cutting position shown by the lead mark of the printed portion of the print job.

Further, as shown in FIG. 8C, there is a method of determining, as the cutting position, a position which is at the upstream side, by a length shorter than a length expressed by the value of the quotient of the sum of L2 and L3 being divided by two, in the conveying direction of the continuous sheet P from the final cutting position of the portion where there is no mark. Namely, the cutting interval is made to be longer at the rear half portion of the border portion than at the front half portion thereof. In this way, preparations for cutting at the cutting mark which follows next can be made with sufficient leeway, and the cutting accuracy improves.

Note that a position which is at the conveying direction upstream side, by an amount equal to the minimum cutting interval of the cutting roller pair 32, from the final cutting position of the portion where there is no mark, may be determined as the cutting position. Namely, cutting is carried out as soon as possible. In this way, the distance until the next cutting mark becomes long, and the cutting accuracy improves.

After the cutting position is determined in step 104, in step 106, the cutting roller pair 32 is controlled so as to cut at the determined cutting position.

In step 108, it is judged whether or not the next mark has been detected within the predetermined range from the cutting position indicated by the mark detected as described above. If the judgment in step 108 is positive, in step 110, cutting operation in accordance with mark detection is carried out. Namely, the cutting roller pair 32 is controlled so as to cut at the cutting position which the mark indicates. Note that, due to the processings of steps 104 through 106, the cutting position, which is at a forward side of the cutting position indicated by the lead mark of the printed portion of the print job, is a position which is at a forward side by an amount which is greater than or equal to the minimum cutting interval of the cutting roller pair 32. Therefore, the continuous sheet P can be cut reliably at the cutting position indicated by the lead mark of the printed portion of the print job.

After step 110, the routine returns to step 108, and the above-described processings are repeated. In the above-described example of FIG. 5, at the printed portions of the print jobs of (5) and (9), cutting in accordance with mark detection is carried out in this way.

On the other hand, if the judgment in step 108 is negative, the routine moves on to step 112, and cutting at the page length set in advance at the post-processing device 30 is carried out. For example, in the above-described example of FIG. 5, at portions (6) or (10), (11), the processing of step 112 is carried out. After cutting, in step 114, it is judged whether or not conveying of the continuous sheet P from the device of the preceding stage is stopped. If the judgment in step 114 is negative, the routine returns to step 108, and cutting at intervals of the set length which is set in advance at the post-processing device 30 is repeated. If the judgment in step 114 is positive, the cutting processing program ends.

Note that, in a method in which a start separator is inserted and a mark for adjustment is printed and the cutting position is controlled, control can be carried out without any restrictions on the interval between the sensor 34 and the cutting roller pair 32, and the interval between the sensor 34 and the cutting roller pair 32 can be made to be small. Therefore, the post-processing device 30 can be made to be compact.

The above exemplary embodiment describes, as an example, a case in which a mark is not printed at the adjustment printing portion. However, even if a mark is printed at the adjustment printing portion, the respective marks can be printed at the obverse printing device 12 and the reverse printing device 14 at intervals which are greater than or equal to the minimum cutting interval of the cutting roller pair 32. Therefore, regardless of the absence/presence of a mark at the adjustment printing portion, there is no problem even if control is carried out in the same way as described above, and the printed portions of the print information of the print job can be cut at appropriate positions.

Second Exemplary Embodiment

A second exemplary embodiment of the present invention describes, as an example, a case in which the sensor 34 which detects the marks is disposed further toward the upstream side in the conveying direction of the continuous sheet P than the sensor 34 of the first exemplary embodiment. Note that, because the overall system structure of the printing system 10 and the structures of the control systems of the obverse printing device 12, the reverse printing device 14, and the post-processing device 30 are similar to those of the first exemplary embodiment, description thereof is omitted.

Figure 9B:
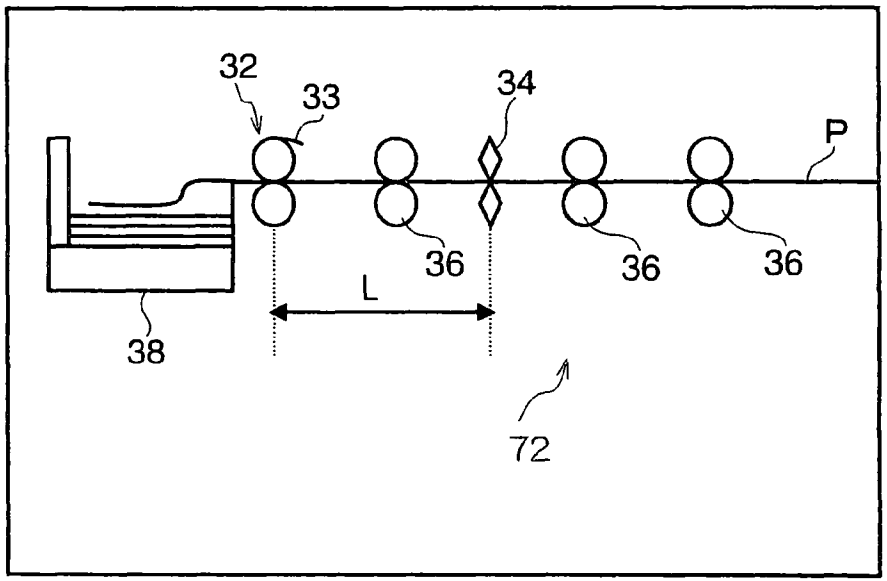
FIG. 9B is a drawing showing the structure of the post-processing mechanism portion of the post-processing device of the second exemplary embodiment.
Figure 9A:
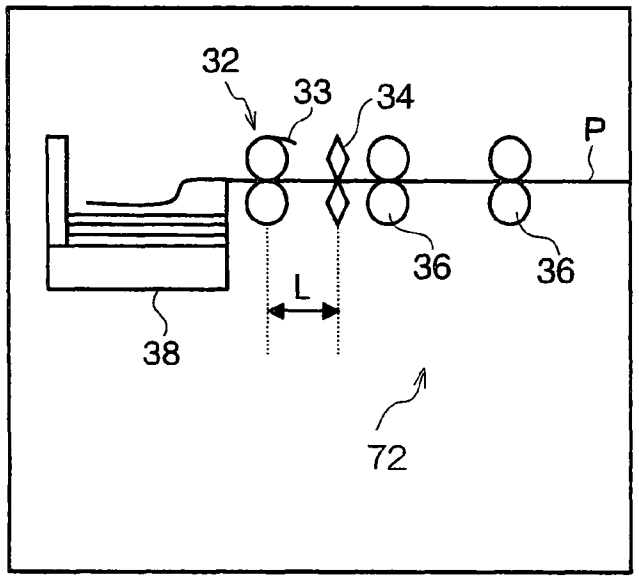
FIG. 9A is a drawing showing the structure of the post-processing mechanism portion of the post-processing device of the first exemplary embodiment.

FIG. 9A is a drawing showing the structure of the post-processing mechanism portion 72 of the post-processing device 30 of the first exemplary embodiment. FIG. 9B is a drawing showing the structure of the post-processing mechanism portion 72 of the post-processing device 30 of the second exemplary embodiment.

As is clear from FIG. 9A and FIG. 9B, the interval L between the cutting roller pair 32 and the sensor 34 is greater in the post-processing device 30 of the present exemplary embodiment. Note that the interval L between the cutting roller pair 32 and the sensor 34 in the post-processing device 30 of the present exemplary embodiment is longer than the minimum cutting interval of the cutting roller pair 32.

The printing processing which is carried out in the present exemplary embodiment will be described next. In the above-described first exemplary embodiment, before printing of the print information of the print jobs, a start separator is inserted and a mark for adjustment is printed. However, in the present exemplary embodiment, before printing of the print information of the print jobs, a start separator is not inserted and a mark for adjustment is not printed. Other than these, printing processing is carried out in the same way as in the first exemplary embodiment.

Next, the cutting processing which is carried out in the present exemplary embodiment will be described. In the cutting processing which is carried out in the present exemplary embodiment, in the flow of the cutting processing which is described by using FIG. 7 in the first exemplary embodiment, only the cutting position determining processing of step 104 differs from the first exemplary embodiment. The other processings are carried out in the same way.

In the present exemplary embodiment, because the interval L between the cutting roller pair 32 and the sensor 34 is long, sufficient time can be taken for the cutting preparations. Accordingly, in step 104, the portion, which is from the cutting position cut immediately before the mark is detected to the cutting position which that detected mark designates, is set as the border portion. At this border portion, the cutting position of the cutting roller pair 32 is determined such that the cutting interval does not become less than the minimum cutting interval of the cutting roller pair 32.

If the final cutting interval of the border portion is greater than or equal to the minimum cutting interval of the cutting roller pair 32, the cutting interval may be longer than or may be shorter than the page length (set length) which is set in advance at the post-processing device 30. If it is longer, the number of times cutting is carried out can be reduced, and, if it is shorter, cutting can be carried out efficiently.

Further, if the length of the border portion is less than or equal to the size of the stocker 38, cutting by the cutting roller pair 32 may be stopped during the time period from the point in time when the mark is detected until the continuous sheet P is cut at the cutting position which that detected mark indicates. As described above, because the interval L between the cutting roller pair 32 and the sensor 34 is longer than the minimum cutting interval of the cutting roller pair 32, the portion where the print information of the print jobs are printed can be reliably cut at the cutting positions indicated by the marks.

Third Exemplary Embodiment

The first and second exemplary embodiments described examples of printing the marks without any differentiation thereamong, and effecting controlling. However, the present exemplary embodiment describes an example in which plural types of marks are readied, and the accommodating positions at the time of accommodating the cut objects, which are cut at the cutting roller pair 32, in the stocker 38 are made to differ in accordance with the types of the marks. Hereinafter, this processing for shifting the accommodating positions of the cut objects will be called offsetting processing.

The structure of the printing system 10 of the present exemplary embodiment is the same as that of the first exemplary embodiment or the second exemplary embodiment, except that an offsetting device (not shown) for carrying out the offsetting processing at the post-processing device 30 is provided between the cutting roller pair 32 and the stocker 38. The CPU 64 of the post-processing device 30 of the present exemplary embodiment controls the offsetting device such that the accommodating positions of the cut objects with respect to the stocker 38 is shifted in accordance with the mark detected at the sensor 34.

The printing processing which is carried out in the present exemplary embodiment will be described. In the above first exemplary embodiment, before printing of the print information of the print jobs, a start separator is inserted and a mark for adjustment is printed. However, for example, the shape of this mark for adjustment may be made to be different from the shapes of the marks for cutting the portion where the print information of the print jobs is printed. In the present exemplary embodiment, the shape of the mark for adjustment is set as a shape for carrying out the offsetting operation.

Figure 10:
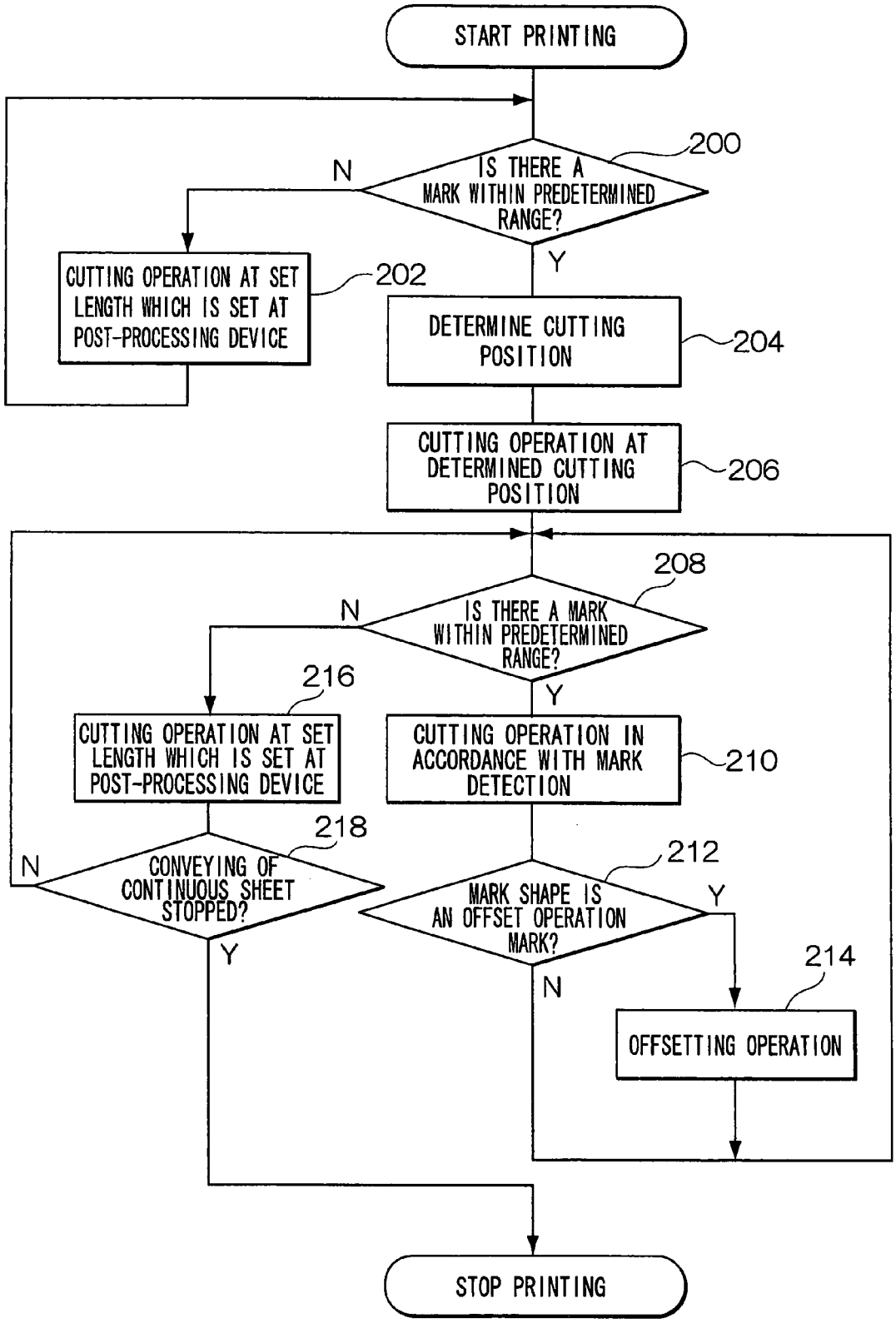
FIG. 10 is a flowchart showing the flow of a cutting processing program executed at the post-processing device of the third exemplary embodiment.

The cutting processing which is carried out in the present exemplary embodiment will be described next. FIG. 10 is a flowchart showing the flow of a cutting processing program which is executed at the post-processing device 30 of the present exemplary embodiment.

The processings from step 200 to step 210 are similar to the processings of steps 100 through 110 of FIG. 7 of the first exemplary embodiment or the second exemplary embodiment. The processings of steps 216 through 218 are similar to the processings of steps 112 through 114 of FIG. 7 of the first exemplary embodiment or the second exemplary embodiment. Therefore, description of these processings will be omitted.

In the present exemplary embodiment, after the cutting operation in accordance with mark detection in step 210, in step 212, it is judged whether or not the shape of the mark is an offsetting operation mark. If the shape of the mark is a shape which is set as an offsetting operation mark, the judgment of step 212 is positive, and in step 214, the offsetting device is made to execute the offsetting operation. In this way, the cut objects can be easily differentiated, and classifying of the cut objects is easy.

If the judgment in step 212 is negative, or after step 214, the routine returns to step 208.

Note that the present exemplary embodiment describes an example in which the shape of the mark for adjustment is set as the shape for carrying out the offsetting operation. However, the present exemplary embodiment is not limited to the same, and the shape of the cutting mark for the print information may be made to be the shape for carrying out the offsetting operation.

Further, as in the second exemplary embodiment, even in cases in which the mark for adjustment is not printed, offsetting processing can be carried out by making the shapes of the marks differ. For example, marks of the same shape are printed for print jobs that are printed in succession. Then, printing is stopped temporarily, and for the print jobs after the printing restarts, a mark with a shape different therefrom is printed. The offsetting processing is carried out at the post-processing device 30 in accordance with the shapes of the marks. This processing can similarly be carried out even in cases in which a mark for adjustment is printed as in the first exemplary embodiment.

Moreover, the offsetting amount may be made to differ in accordance with the shapes of the marks.

Here, an example is described in which the shapes of the marks are made to differ, but the present exemplary embodiment is not limited to the same, and the colors of the marks, the sizes of the marks, or the like may be made to differ.

Further, the above first through third exemplary embodiments describe, as an example, a system in which printing onto a continuous sheet is carried out by two printing devices in succession. However, there may be one printing device or three or more printing devices.

An object of the present invention is to provide a printing system, a cutting device, and a cutting method which can cut a continuous sheet at suitable cutting positions even in cases in which the continuous sheet is printed on and cut at a printing device which does not carry out operation in units of a page length.

In order to achieve the above object, a printing system of a first aspect of the present invention is structured to include: a printing device having a printing portion that prints print information onto a continuous sheet and prints cutting information indicating a cutting position for cutting the continuous sheet, and a printing control portion that controls printing of the printing portion; and a cutting device having a cutting portion that cuts the continuous sheet which has passed through the printing device, a conveying portion that conveys to the cutting portion the continuous sheet which has passed through the printing device, a detecting portion that detects the cutting information from the continuous sheet while the continuous sheet is conveyed by the conveying portion, and a cutting control portion which controls the cutting portion such that the continuous sheet is cut at the cutting position indicated by the cutting information, when the cutting information is detected at the continuous sheet within a predetermined range from a cutting position by the cutting portion at an upstream side in a conveying direction of the conveying portion, and controls the cutting portion such that the continuous sheet is cut at a set length which is set in advance, when the cutting information is not detected at the continuous sheet within the predetermined range from the cutting position by the cutting portion at the upstream side in the conveying direction of the conveying portion.

In a second aspect, in the printing system of the first aspect, a maximum value of a printing interval of the cutting information is set in advance, and the predetermined range is set to a value which is greater than the maximum value.

In a third aspect, in the printing system of the first or second aspect, the set length is a same length as the predetermined range.

In a fourth aspect, in the printing system of the first or second aspect, the set length is set to an arbitrary length which is less than the predetermined range.

In a fifth aspect, in any one of the printing systems of the first through fourth aspects, the cutting portion is structured so as to not be able to cut the continuous sheet at intervals which are less than a predetermined cutting interval, and the cutting control portion controls the cutting position of the cutting portion such that a cutting interval at a border portion between a portion where the cutting information is not detected and a portion where the cutting information is detected, is not less than the predetermined cutting interval, when the cutting information is detected after not having been detected at the continuous sheet within the predetermined range from the cutting position by the cutting portion at the upstream side in the conveying direction of the conveying portion.

In a sixth aspect, in the printing system of the fifth aspect, the printing control portion controls the printing portion so as to insert a blank page for adjustment as the border portion at a forward side of a portion where the print information is printed, and print cutting information for adjustment onto the inserted blank page.

In a seventh aspect, in the printing system of the sixth aspect, the cutting control portion controls the cutting portion such that, regardless of a cutting position indicated by the cutting information for adjustment, the continuous sheet is not cut at a position which is less than the predetermined cutting interval from a cutting position at a downstream side in the conveying direction of the conveying portion indicated by cutting information which is printed after the cutting information for adjustment, when the cutting information for adjustment is detected after the cutting information has not been detected at the continuous sheet within the predetermined range from the cutting position by the cutting portion at the upstream side in the conveying direction of the conveying portion.

In an eighth aspect, in the printing system of the seventh aspect, when the cutting information for adjustment is detected, the cutting control portion controls the cutting portion such that, regardless of the cutting position indicated by the cutting information for adjustment, the continuous sheet is cut at a position which is at the upstream side, in the conveying direction of the continuous sheet, from a final cutting position of the portion where the cutting information is not detected, by a length expressed by a value which is the quotient of the sum of an interval between the final cutting position of the portion where the cutting information is not detected and the cutting position indicated by the cutting information for adjustment, and a printing interval of cutting information for cutting a printed portion where the print information is printed, divided by two.

In a ninth aspect, in the printing system of the seventh aspect, when the cutting information for adjustment is detected, the cutting control portion controls the cutting portion such that, regardless of the cutting position indicated by the cutting information for adjustment, the continuous sheet is cut at a position which is at the upstream side, in the conveying direction of the continuous sheet, from a final cutting position of the portion where the cutting information is not detected, by a length which is shorter than a length expressed by a value which is the quotient of the sum of an interval between the final cutting position of the portion where the cutting information is not detected and the cutting position indicated by the cutting information for adjustment, and a printing interval of cutting information for cutting a printed portion where the print information is printed, divided by two.

In a tenth aspect, in the printing system of the seventh aspect, when the cutting information for adjustment is detected, the cutting control portion controls the cutting portion such that, regardless of the cutting position indicated by the cutting information for adjustment, the continuous sheet is cut at a position which is at the upstream side, in the conveying direction of the continuous sheet, from a final cutting position of the portion where the cutting information is not detected, by the predetermined cutting interval.

In an eleventh aspect, in the printing system of the fifth aspect, the cutting portion is disposed at a position which is at the downstream side, in the conveying direction of the continuous sheet, from the detecting portion by an interval which is longer than the predetermined cutting interval, and the cutting control portion controls the cutting position of the cutting portion such that a cutting interval at the border portion, which is a portion from a cutting position which is cut immediately before the cutting information is detected to a cutting position indicated by that detected cutting information, is not less than the predetermined cutting interval, when the cutting information is detected after not having been detected at the continuous sheet within the predetermined range from the cutting position by the cutting portion at the upstream side in the conveying direction of the conveying portion.

In a twelfth aspect, in the printing system of the eleventh aspect, the cutting control portion controls the cutting position of the cutting portion such that the cutting interval at the border portion is a length which is shorter than the set length and greater than or equal to the predetermined cutting interval.

In a thirteenth aspect, in the printing system of the eleventh aspect, the cutting control portion controls the cutting position of the cutting portion such that the cutting interval at the border portion is longer than the set length.

In a fourteenth aspect, in the printing system of the thirteenth aspect, the cutting control portion controls the cutting portion such that cutting of the continuous sheet is not carried out during a time period from a time when the cutting information is detected after not having been detected at the continuous sheet within the predetermined range from the cutting position by the cutting portion at the upstream side in the conveying direction of the conveying portion to a time when cutting at a cutting position indicated by the detected cutting information is carried out.

In a fifteenth aspect, in any one of the printing systems of the first through fourteenth aspects, the printing portion and the printing control portion are configured to print a plurality of types of cutting information, and the printing system further comprises an accommodation control portion which makes accommodation positions at a time of accommodation, in a predetermined storage portion, of cut objects which are obtained by cutting of the continuous sheet, differ in accordance with types of the cutting information printed on the continuous sheet.

A cutting device of a sixteenth aspect is structured to include: a cutting portion that cuts a continuous sheet which has passed through a printing device having a printing portion which prints print information onto the continuous sheet and prints cutting information indicating a cutting position for cutting the continuous sheet, and a printing control portion that controls printing of the printing portion; a conveying portion that conveys the continuous sheet, which has passed through the printing device, to the cutting portion; a detecting portion that detects the cutting information from the continuous sheet while the continuous sheet is being conveyed by the conveying portion; and a cutting control portion which controls the cutting portion such that the continuous sheet is cut at the cutting position indicated by the cutting information, when the cutting information is detected at the continuous sheet within a predetermined range from a cutting position by the cutting portion at an upstream side in a conveying direction of the conveying portion, and controls the cutting portion such that the continuous sheet is cut at a set length which is set in advance, when the cutting information is not detected at the continuous sheet within the predetermined range from the cutting position by the cutting portion at the upstream side in the conveying direction of the conveying portion.

A cutting method of a seventeenth aspect includes: conveying a continuous sheet, which has passed through a printing device which prints print information onto the continuous sheet and prints cutting information indicating a cutting position for cutting the continuous sheet, to a cutting portion which cuts the continuous sheet; detecting the cutting information from the continuous sheet while the continuous sheet is being conveyed; and controlling the cutting portion such that the continuous sheet is cut at the cutting position indicated by the cutting information, when the cutting information is detected at the continuous sheet within a predetermined range from a cutting position by the cutting portion at an upstream side in a conveying direction of the conveying, and controlling the cutting portion such that the continuous sheet is cut at a set length which is set in advance, when the cutting information is not detected at the continuous sheet within the predetermined range from the cutting position by the cutting portion at the upstream side in the conveying direction of the conveying.

As described above, in accordance with the present invention, there is the effect that a continuous sheet can be cut at suitable cutting positions, even in cases in which the continuous sheet is printed on and cut at a printing device which does not operate in units of a page length.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A printing system comprising:

a printing device having a printing portion that prints print information onto a continuous sheet and prints cutting information indicating a cutting position for cutting the continuous sheet, and a printing control portion that controls printing of the printing portion; and a cutting device having a cutting portion that cuts the continuous sheet which has passed through the printing device, a conveying portion that conveys to the cutting portion the continuous sheet which has passed through the printing device, a detecting portion that detects the cutting information from the continuous sheet while the continuous sheet is conveyed by the conveying portion, and a cutting control portion which controls the cutting portion such that the continuous sheet is cut at the cutting position indicated by the cutting information, when the cutting information is detected at the continuous sheet within a predetermined range from a cutting position by the cutting portion at an upstream side in a conveying direction of the conveying portion, and controls the cutting portion such that the continuous sheet is cut at a set length which is set in advance independently of the predetermined range, when the cutting information is not detected at the continuous sheet within the predetermined range from the cutting position by the cutting portion at the upstream side in the conveying direction of the conveying portion, wherein the cutting portion is structured so as to not be able to cut the continuous sheet at intervals which are less than a predetermined cutting interval, the cutting control portion controls the cutting position of the cutting portion such that a cutting interval at a border portion between a portion where the cutting information is not detected and a portion where the cutting information is detected, is not less than the predetermined cutting interval, when the cutting information is detected after not having been detected at the continuous sheet within the predetermined range from the cutting position by the cutting portion at the upstream side in the conveying direction of the conveying portion, and the printing control portion controls the printing portion so as to insert a blank page for adjustment as the border portion at a forward side of a portion where the print information is printed, and print cutting information for adjustment onto the inserted blank page.

2. The printing system of claim 1, wherein a maximum value of a printing interval of the cutting information is set in advance, and the predetermined range is set to a value which is greater than the maximum value.

3. The printing system of claim 2, wherein the set length is a same length as the predetermined range.

4. The printing system of claim 2, wherein the set length is set to an arbitrary length which is less than the predetermined range.

5. The printing system of claim 1, wherein the set length is a same length as the predetermined range.

6. The printing system of claim 1, wherein the set length is set to an arbitrary length which is less than the predetermined range.

7. The printing system of claim 1, wherein, the cutting control portion controls the cutting portion such that, regardless of a cutting position indicated by the cutting information for adjustment, the continuous sheet is not cut at a position which is less than the predetermined cutting interval from a cutting position at a downstream side in the conveying direction of the conveying portion indicated by cutting information which is printed after the cutting information for adjustment, when the cutting information for adjustment is detected after the cutting information has not been detected at the continuous sheet within the predetermined range from the cutting position by the cutting portion at the upstream side in the conveying direction of the conveying portion.

8. The printing system of claim 7, wherein, when the cutting information for adjustment is detected, the cutting control portion controls the cutting portion such that, regardless of the cutting position indicated by the cutting information for adjustment, the continuous sheet is cut at a position which is at the upstream side, in the conveying direction of the continuous sheet, from a final cutting position of the portion where the cutting information is not detected, by a length expressed by a value which is the quotient of the sum of an interval between the final cutting position of the portion where the cutting information is not detected and the cutting position indicated by the cutting information for adjustment, and a printing interval of cutting information for cutting a printed portion where the print information is printed, divided by two.

9. The printing system of claim 7, wherein, when the cutting information for adjustment is detected, the cutting control portion controls the cutting portion such that, regardless of the cutting position indicated by the cutting information for adjustment, the continuous sheet is cut at a position which is at the upstream side, in the conveying direction of the continuous sheet, from a final cutting position of the portion where the cutting information is not detected, by a length which is shorter than a length expressed by a value which is the quotient of the sum of an interval between the final cutting position of the portion where the cutting information is not detected and the cutting position indicated by the cutting information for adjustment, and a printing interval of cutting information for cutting a printed portion where the print information is printed, divided by two.

10. The printing system of claim 7, wherein, when the cutting information for adjustment is detected, the cutting control portion controls the cutting portion such that, regardless of the cutting position indicated by the cutting information for adjustment, the continuous sheet is cut at a position which is at the upstream side, in the conveying direction of the continuous sheet, from a final cutting position of the portion where the cutting information is not detected, by the predetermined cutting interval.

11. The printing system of claim 1, wherein the cutting portion is disposed at a position which is at the downstream side, in the conveying direction of the continuous sheet, from the detecting portion by an interval which is longer than the predetermined cutting interval, and the cutting control portion controls the cutting position of the cutting portion such that a cutting interval at the border portion, which is a portion from a cutting position which is cut immediately before the cutting information is detected to a cutting position indicated by that detected cutting information, is not less than the predetermined cutting interval, when the cutting information is detected after not having been detected at the continuous sheet within the predetermined range from the cutting position by the cutting portion at the upstream side in the conveying direction of the conveying portion.

12. The printing system of claim 11, wherein the cutting control portion controls the cutting position of the cutting portion such that the cutting interval at the border portion is a length which is shorter than the set length and greater than or equal to the predetermined cutting interval.

13. The printing system of claim 11, wherein the cutting control portion controls the cutting position of the cutting portion such that the cutting interval at the border portion is longer than the set length.

14. The printing system of claim 13, wherein the cutting control portion controls the cutting portion such that cutting of the continuous sheet is not carried out during a time period from a time when the cutting information is detected after not having been detected at the continuous sheet within the predetermined range from the cutting position by the cutting portion at the upstream side in the conveying direction of the conveying portion to a time when cutting at a cutting position indicated by the detected cutting information is carried out.

15. The printing system of claim 1, wherein the printing portion and the printing control portion are configured to print a plurality of types of cutting information, and the printing system further comprises an accommodation control portion which makes accommodation positions at a time of accommodation, in a predetermined storage portion, of cut objects which are obtained by cutting of the continuous sheet, differ in accordance with types of the cutting information printed on the continuous sheet.

16. A cutting device comprising:

a cutting portion that cuts a continuous sheet which has passed through a printing device having a printing portion which prints print information onto the continuous sheet and prints cutting information indicating a cutting position for cutting the continuous sheet, and a printing control portion that controls printing of the printing portion;

a conveying portion that conveys the continuous sheet, which has passed through the printing device, to the cutting portion;

a detecting portion that detects the cutting information from the continuous sheet while the continuous sheet is being conveyed by the conveying portion; and a cutting control portion which controls the cutting portion such that the continuous sheet is cut at the cutting position indicated by the cutting information, when the cutting information is detected at the continuous sheet within a predetermined range from a cutting position by the cutting portion at an upstream side in a conveying direction of the conveying portion, and controls the cutting portion such that the continuous sheet is cut at a set length which is set in advance independently of the predetermined range, when the cutting information is not detected at the continuous sheet within the predetermined range from the cutting position by the cutting portion at the upstream side in the conveying direction of the conveying portion, wherein the cutting portion is structured so as to not be able to cut the continuous sheet at intervals which are less than a predetermined cutting interval, the cutting control portion controls the cutting position of the cutting portion such that a cutting interval at a border portion between a portion where the cutting information is not detected and a portion where the cutting information is detected, is not less than the predetermined cutting interval, when the cutting information is detected after not having been detected at the continuous sheet within the predetermined range from the cutting position by the cutting portion at the upstream side in the conveying direction of the conveying portion, and the printing control portion controls the printing portion so as to insert a blank page for adjustment as the border portion at a forward side of a portion where the print information is printed, and print cutting information for adjustment onto the inserted blank page.

17. A cutting method comprising:

conveying a continuous sheet, which has passed through a printing device having a printing portion which prints print information onto the continuous sheet and prints cutting information indicating a cutting position for cutting the continuous sheet, to a cutting portion which cuts the continuous sheet;

detecting the cutting information from the continuous sheet while the continuous sheet is being conveyed; and controlling the cutting portion such that the continuous sheet is cut at the cutting position indicated by the cutting information, when the cutting information is detected at the continuous sheet within a predetermined range from a cutting position by the cutting portion at an upstream side in a conveying direction of the conveying, and controlling the cutting portion such that the continuous sheet is cut at a set length which is set in advance independently of the predetermined range, when the cutting information is not detected at the continuous sheet within the predetermined range from the cutting position by the cutting portion at the upstream side in the conveying direction of the conveying, wherein the cutting portion is structured so as to not be able to cut the continuous sheet at intervals which are less than a predetermined cutting interval, the controlling of the cutting portion controls the cutting position of the cutting portion such that a cutting interval at a border portion between a portion where the cutting information is not detected and a portion where the cutting information is detected, is not less than the predetermined cutting interval, when the cutting information is detected after not having been detected at the continuous sheet within the predetermined range from the cutting position by the cutting portion at the upstream side in the conveying direction of the conveying, and a printing control portion controls the printing portion so as to insert a blank page for adjustment as the border portion at a forward side of a portion where the print information is printed, and print cutting information for adjustment onto the inserted blank page.

* * * * *